United States Patent [19]

Wilkinson

[11] 4,366,035

[45] Dec. 28, 1982

[54] ELECTRODEPOSITION OF GOLD ALLOYS

[75] Inventor: Peter Wilkinson, Cinderford, England

[73] Assignee: Engelhard Corporation, Iselin, N.J.

[21] Appl. No.: 143,051

[22] Filed: Apr. 23, 1980

[30] Foreign Application Priority Data

Apr. 24, 1979 [GB] United Kingdom ..... 7914220
Apr. 24, 1979 [GB] United Kingdom ..... 7914221

[51] Int. Cl.[3] ..... C25D 3/62
[52] U.S. Cl. ..... 204/44
[58] Field of Search ..... 204/44, 123

[56] References Cited

U.S. PATENT DOCUMENTS 3,475,292 10/1969 Shoushanian ..... 204/44
3,666,640 5/1972 Smith ..... 204/44
4,048,023 9/1977 Stevens ..... 204/44
4,199,416 4/1980 Middleton et al. ..... 204/44

FOREIGN PATENT DOCUMENTS 534215 9/1971 Switzerland .

*Primary Examiner*—G. L. Kaplan

[57] ABSTRACT

A cyanide-free bath for the electrodeposition of pink gold alloys and gold alloys having a white coloration which comprises an aqueous alkaline mixture of a gold sulphite, a water soluble copper alloying salt or complex, a water soluble palladium alloying salt or complex and an alkali metal sulphite or ammonium sulphite. The said bath may also include a water soluble brightening agent in the form of an arsenic, antimony or thallium salt, complex or chelate and a surface active agent. The said alloys are deposited to a thickness of up to 30 microns.

25 Claims, No Drawings

ELECTRODEPOSITION OF GOLD ALLOYS

This invention relates to the electrodeposition of gold alloys onto a substrate an to an electroplating bath and process which can be used to obtain gold alloy deposits.

Specifically, this invention relates to an electroplating bath and process for obtaining a pink gold alloy deposit. Pink gold alloys are useful for decorative purposes as, for example, in the manufacture of spectacle frames. Also, this invention relates to an electroplating bath and process for obtaining a hard, bright gold alloy deposit having a white coloration. Such white gold alloy deposits are also useful for decorative purposes.

BACKGROUND OF THE INVENTION

The commercially available electroplating processes and baths for producing white gold alloys are based on cyanide-containing electroplating baths. However, such baths are notoriously unstable with respect to color and deposit composition.

Also, the known electroplating processes for obtaining pink gold alloys generally use an acidic gold cyanide-containing electroplating baths as described in British No. 1,224,507. However, such pink gold alloys are usually difficult to obtain because the presence of copper, which is the main alloying metal producing the pink coloration, makes the bath sensitive to operating parameters, especially changes in concentration. Uniformly reproducable, hard, bright gold-copper alloys having a pink coloration can normally be obtained from such acid cyanide baths only by careful regulation of the bath components and operating conditions.

Another difficulty is the necessity of removing from the spent baths any remaining cyanide so as to provide a cyanide-free effluent which will not give rise to pollution problems.

Recently there has been disclosed an electroplating bath for producing a pink gold-alloy deposit which utilizes an amino-gold sulphite complex. The said complex is formed by reacting a trivalent gold compound with an amine followed by the reaction of the resulting product with an alkali metal or ammonium sulphite in at least twice the molar quantity. This process is described in British No. 1,325,352. However, in practice, this bath is not easy to operate and it is relatively expensive. Also, it has the disadvantages of becoming easily poisoned by airborne or dragged-in cyanide contamination which gives rise to color stability problems.

THE INVENTION

It is an object of this invention to provide an electroplating bath and process capable of depositing onto a substrate a hard, bright gold alloy electrodeposit having a pink coloration absent the disadvantages of known acid gold cyanide-containing electroplating baths and processes. This invention overcomes the pollution problems and other disadvantages usually associated with baths containing amino-gold sulphite complexes.

Another object of this invention provides for an electroplating bath and process capable of producing a hard, bright gold alloy electrodeposit having a white coloration and one which is not as susceptible to the color stability problems encountered with previously known cyanide-containing baths and processes. The composition of the bath for both pink gold and white gold deposition is in many respects identical and a common pH range of from about 7.0–12 is applicable.

Pink Gold: An aqueous alkaline cyanide-free electroplating bath is used for depositing onto a substrate a hard, bright gold alloy electro deposit having a pink coloration. This bath comprises the following essential constituents:

| | Grams/Liter |
|---|---|
| Gold (Added as an alkali metal or ammonium gold sulphite) | 4–20 |
| Copper (Added as a water soluble salt or complex) | 0.1–3.0 |
| Palladium (Added as a water soluble salt or complex) | 0.2–5.0 |
| Alkali metal sulphite or ammonium sulphite (Calculated as free sulphite ion) | 5–200 |
| Brightening element selected from arsenic, antimony and thallium (Added as a water soluble salt, complex or chelate) | 0.001–0.5 |
| Surface active agent | 0.001–0.5 |
| Water | qs. to 1 liter |

Although it is not an essential ingredient, nevertheless, it is desirable to include in the electroplating bath a buffering agent and/or a conducting salt. The said buffering agent or salt may be present in minor amounts up to 150 grams/liter of the electroplating solution.

The pH of this bath is preferably in the range of from about 7.0 to 11.5, advantageously, 8.5 to 11.5 and, most preferably, from about 9.5. To maintain these pH levels alkali metal hydroxides as, for example, potassium hydroxide, or a weak acid such as citric acid, may be added as required in the form of a 10% aqueous solution.

The process for electrodepositing the hard, bright pink gold alloy onto a conductive substrate, consists essentially of electroplating the conductive substrate as a cathode in an aqueous alkaline cyanide-free electroplating bath of the type hereinbefore defined. The cathode current density is in the range of from about 0.1 to 1.5 amp/dm$^2$ (amperes per square decimeter) and the temperature can be varied within a range of from about 40° to 80° C. Preferably, the cathode current density is about 0.5 amp/dm$^2$ and the temperature is maintained at about 60° C. The cathode should be moderately agitated during the electroplating step.

In formulating the pink gold electroplating bath the gold may be introduced in the form of an alkali metal gold sulphite such as sodium gold sulphite or potassium gold sulphite or as an ammonium gold sulphite complex. The copper alloying element may be introduced as a water soluble copper salt or complex such as copper sulphate, copper tartrate or copper citrate; and the palladium alloying element may be introduced as a water soluble alkali metal palladium sulphite salt or complex as, for example, sodium palladium sulphite or potassium palladium sulphite or as ammonium palladium sulphite complex or as palladium citrate. The free sulphite ion ($SO_3^{2-}$) may be added as sodium, potassium or ammonium sulphite. The buffering agent and/or conducting salt, if utilized, may be selected from among alkali metal, alkaline earth metal or ammonium phosphates, borates, sulphates, carbonates, acetates, citrates, gluconates and tartrates or boric acid.

The brightening agent should be used in the form of a soluble compound or complex as, for example, arsenic trioxide which is added in aqueous solution. Other suitable brightening agents include, for example, potassium antimony tartrate or thallium sulphate. The type of surface active agent employed in the bath is not critical and any anionic, cationic or non-ionic surfactant effective within the stated pH range can be employed as, for example, an alkyl phosphate ester or an alcohol alkoxylate.

The bright, pink hard gold alloy obtained by means of this invention is a gold/copper/palladium alloy in which the elements are present in a range of from about 86–94% Au, 2–8% Cu and 2–6% Pd based on the total weight of the alloy deposit. Preferably, the said elements are present within a weight-percent range of from about 88–90% Au, 7–8% Cu and 3–4% Pd.

White Gold: Another aspect of this invention provides for an aqueous alkaline cyanide-free electroplating bath which deposits onto a substrate a hard, bright gold alloy electrodeposit having a white coloration. This bath comprises the following essential constituents:

| | Grams/Liter |
|---|---|
| Gold (Added as an alkali metal or ammonium gold sulphite) | 4–20 |
| Palladium (Added as a water-soluble salt or complex) | 0.2–5.0 |
| Copper (Added as a water-soluble salt or complex) | 0.1–3.0 |
| Alkali metal sulphite or ammonium sulphite (Calculated as free sulphite ion) | 5–200 |
| Water | qs. to 1 liter |

Although it is not an essential ingredient, nevertheless, it is desirable to include in the electroplating bath a buffering agent and/or a conducting salt. The said buffering agent or salt may be present in minor amounts of up to 150 grams/liter of the electroplating solution.

The pH of this bath is preferably in the range from about 7.0 to 10.5, advantageously, 9 to 10 and most preferably 9.5. The maintenance of the pH at the required value can be effected by the addition of an alkali metal hydroxide as, for example, potassium hydroxide, or a weak acid as, for example, citric acid in the form of a 10% aqueous solution thereof.

The method for depositing the hard, bright, white gold alloy onto a conductive substrate consists essentially of using the conductive substrate as a cathode in an aqueous alkaline cyanide-free electroplating bath of the type hereinbefore defined. The cathode current density is in the range of from about 0.25 to 1.25 amp/dm$^2$ and the temperature can be varied within a range of from about 50° to 65° C. Preferably, the cathode current density is about 0.5 amp/dm$^2$ and the temperature is maintained at about 60° C. The cathode should be moderately agitated during the electroplating step.

In formulating the white gold electroplating bath the gold may be introduced in the form of an alkali metal gold sulphite such as sodium gold sulphite or potassium gold sulphite or as an ammonium gold sulphite complex. The palladium alloying element may be introduced as a water soluble alkali metal palladium sulphite salt or complex as, for example, sodium palladium sulphite or potassium palladium sulphite or an ammonium palladium sulphite complex, or palladium citrate; and the copper alloying element may be introduced as a water soluble salt or complex such as copper sulphate, copper tartrate or copper citrate. The sulphite (present as free ($SO_3^{2-}$) may be added as sodium, potassium or ammonium sulphite. The buffering agent and/or conducting salt may be selected from among alkali metal, alkaline earth metal or ammonium phosphates, borates, sulphates, carbonates, acetates, citrates, gluconates and tartrates or boric acid.

The bright, white, hard gold alloy obtained by this invention is a gold/palladium/copper alloy in which these elements are present in a range of from about 85–95% Au, 3–10% Pd and 2–5% Cu based on the total weight of the alloy deposit. Preferably, the deposit is an alloy of the following composition: 89–93% Au, 5–8% Pd and 2–3% Cu with the proviso that the alloy always contains more palladium than copper.

In order to deposit the pink gold alloy and white gold alloy onto the substrate surface it is necessary to use a suitably active metal anode. A platinum anode or platinised titanium anode affords good results although a variety of other metal anodes may also be employed.

The following examples illustrate the electroplating baths of this invention and the method by which they are used to deposit gold alloys onto a substrate. However, it is to be understood that the examples are illustrative only and are not intended to be limitative.

EXAMPLE 1

Pink Gold Alloy

An electroplating bath was prepared by dissolving in demineralised water the following constituents. With the exception of the surface active agent the concentrations of the said constituents are expressed in grams/liter:

| | |
|---|---|
| Potassium gold sulphite | 10 (as gold) |
| Copper sulphate | 0.5 (as copper) |
| Palladium citrate | 1.5 (as palladium) |
| Potassium sulphite | 50 (as ($SO_3^{2-}$) |
| Tripotassium citrate | 20 |
| Arsenic trioxide (aqueous solution) | 0.05 (as arsenic) |
| Surface active agent (Triton Q.S.-44) | 5 ml/l |

The commercially available surface active agent Triton Q.S.-44 (Sold by Rohm and Haas (U.K.) Limited) is an anionic phosphate surfactant in free acid form.

A brass panel was electroplated to a thickness of 3 microns in the foregoing bath at a pH of 9.5 and a cathode current density of 0.5 amp/dm$^2$ while maintaining the temperature at 60° C. with moderate agitation. A platinum coated titanium mesh anode was used.

The deposit thus obtained was bright and pink, extremely hard (350 HV-Vickers hardness number), ductile and pore-free. Analysis showed the deposit to be a gold/copper/palladium alloy having the following weight-percent concentrations: 90% Au, 7% Cu and 3% Pd.

EXAMPLE 2

Pink Gold Alloy

The procedure of Example 1 was repeated except that the Triton Q.S.-44 was replaced by the commercially available surface active agent Cu 84 (sold by LPW Neuss, West Germany) which is an alkyl phosphate ester.

EXAMPLE 3

Pink Gold Alloy

An electroplating bath was prepared by dissolving in demineralised water the following constituents. With the exception of the surface active agent the concentrations of the said constituents are expressed in grams/-liter:

| | |
|---|---|
| Potassium gold sulphite | 10 (as gold) |
| Copper citrate | 0.15 (as copper) |
| Potassium palladium sulphite | 0.5 (as palladium) |
| Potassium sulphite | 26 (as $(SO_3^{2-})$ |
| Tripotassium citrate | 20 |
| Boric acid | 10 |
| Arsenic trioxide (aqueous solution) | 0.06 (as arsenic) |
| Surface active agent (Cu 84) | 1 ml/l |

The pH of the bath was adjusted to a value of 9.5 by the appropriate addition of potassium hydroxide or citric acid.

A brass panel was electroplated using the foregoing bath in the manner described in Example 1 to obtain a bright, pink, pore-free ductile and extremely hard deposit. Analysis showed the deposit to be an alloy having the following weight-percent composition: 94% Au, 2% Cu and 4% Pd.

EXAMPLE 4

Pink Gold Alloy

An electroplating bath, which contained no conducting salt or buffering agent, was formulated by dissolving in demineralised water the following constituents. With the exception of the surface active agent the concentrations of the said constituents are expressed in grams/-liter:

| | |
|---|---|
| Ammonium gold sulphite | 50 (as gold) |
| Copper sulphate | 0.1 (as copper) |
| Palladium diammine dinitrite | 1.5 (as palladium) |
| Ammonium sulphite | 150 (as $(SO_3^{2-})$ |
| Arsenic trioxide (aqueous solution) | 0.02 (as arsenic) |
| Surface active agent (Cu 84) | 5 ml/l |

The pH of the bath was adjusted to a value of 7–7.5 by the appropriate addition of ammonium hydroxide or citric acid.

A brass panel was electroplated using the foregoing bath in the manner described in Example 1 to obtain a bright, pink, ductile and extremely hard deposit consisting of 91% Au, 4% Cu and 5% Pd.

EXAMPLE 5

Pink Gold Alloy

An electroplating bath was prepared by dissolving in demineralised water the following constituents. With the exception of the surface active agent the concentrations of the said constituents are expressed in grams/-liter:

| | |
|---|---|
| Potassium gold sulphite | 10 (as gold) |
| Copper citrate | 1.0 (as copper) |
| Potassium palladium sulphite | 1.5 (as palladium) |
| Potassium sulphite | 40 (as $(SO_3^{2-})$ |
| Tripotassium citrate | 60 |
| Boric acid | 10 |
| Arsenic trioxide (aqueous solution) | 0.06 (as arsenic) |

-continued

| | |
|---|---|
| Surface active agent (Cu 84) | 5 ml/l |

The pH of the bath was adjusted to a value of 9.5 by the appropriate addition of potassium hydroxide or citric acid.

A brass panel was electroplated using the foregoing bath in the manner described in Example 1 to obtain a bright, pink, pore-free ductile and extremely hard deposit which on analysis was found to be the alloy 88% Au, 8% Cu and 4% Pd.

EXAMPLE 6

Pink Gold Alloy

An electroplating bath was prepared by dissolving in demineralised water the following constituents. With the exception of the surface active agent the concentrations of the said constituents are expressed in grams/-liter:

| | |
|---|---|
| Potassium gold sulphite | 10 (as gold) |
| Copper citrate | 0.5 (as copper) |
| Potassium palladium sulphite | 0.5 (as palladium) |
| Potassium sulphite | 40 (as $(SO_3^{2-})$ |
| Tripotassium citrate | 20 |
| Boric acid | 10 |
| Potassium antimony tartrate | 0.1 (as antimony) |
| Surface active agent (Cu 84) | 2 ml/l |

The pH of the bath was adjusted to a value of 9.5 by the appropriate addition of potassium hydroxide or citric acid.

A brass panel was electroplated using the foregoing bath in the manner described in Example 1 to obtain a bright, pink, pore-free ductile and extremely hard deposit which on analysis was found to be the alloy 88% Au, 8% Cu and 4% Pd.

EXAMPLE 7

Pink Gold Alloy

An electroplating bath was prepared by dissolving in demineralised water the following constituents. With the exception of the surface active agent the concentrations of the said constituents are expressed in grams/-liter:

| | |
|---|---|
| Potassium gold sulphite | 10 (as gold) |
| Copper citrate | 0.5 (as copper) |
| Potassium palladium sulphite | 0.5 (as palladium) |
| Potassium sulphite | 40 (as $(SO_3^{2-})$ |
| Tripotassium citrate | 20 |
| Boric acid | 10 |
| Thallium sulphate | 0.01 (as thallium) |
| Surface active agent (Cu 84) | 2 ml/l |

The pH of the bath was adjusted to a value of 9.5 by the appropriate addition of potassium hydroxide or citric acid.

A brass panel was electroplated using the foregoing bath in the manner described in Example 1 to obtain a bright, pink, pore-free ductile and extremely hard deposit which on analysis was found to be the alloy 88% Au, 8% Cu and 4% Pd.

EXAMPLE 8

White Gold Alloy

An electroplating bath was prepared by dissolving in water the following constituents. All concentrations are expressed in grams/liter:

| | |
|---|---|
| Potassium gold sulphite | 10 (as gold) |
| Potassium palladium sulphite | 1.5 (as palladium) |
| Copper citrate | 0.2 (as copper) |
| Potassium sulphite | 30 (as $(SO_3^{2-})$ |
| Ammonium citrate | 20 |
| Boric acid | 10 |

A brass panel was electroplated at a pH of 9.5 to a thickness of 3 microns in the foregoing bath. The mixture was maintained at a temperature of 60° C. and a cathode current density of 0.5 amp/dm$^2$, with moderate agitation using a platinum anode. The deposit obtained was bright and white, extremely hard (340 HV-Vickers hardness number) and ductile. Analysis showed the deposit to be a gold, palladium and copper alloy having the following weight percent concentrations: 89% Au, 8% Pd and 3% Cu.

EXAMPLE 9

White Gold Alloy

An electroplating bath was prepared by dissolving in demineralised water the following constituents. With the exception of the surface active agent the concentrations of the said constituents are expressed in grams/-liter:

| | |
|---|---|
| Potassium gold sulphite | 10 (as gold) |
| Potassium palladium sulphite | 1.5 (as palladium) |
| Copper citrate | 0.2 (as copper) |
| Potassium sulphite | 40 (as sulphite ion) |
| Ammonium citrate | 10 |
| Boric acid | 10 |

The pH of the bath was adjusted to a value of 9.5 by the appropriate addition of potassium hydroxide or citric acid.

A brass panel was electroplated using the foregoing bath in the manner described in Example 1 to obtain a bright, white, ductile and extremely hard deposit, which on analysis was found to be the alloy 89% Au, 8% Pd and 3% Cu.

EXAMPLE 10

White Gold Alloy

An electroplating bath was prepared by dissolving in demineralised water the following constituents. With the exception of the surface active agent the concentrations of the said constituents are expressed in grams/-liter:

| | |
|---|---|
| Potassium gold sulphite | 10 (as gold) |
| Potassium palladium sulphite | 0.6 (as palladium) |
| Copper citrate | 0.2 (as copper) |
| Potassium sulphite | 52 (as sulphite ion) |
| Potassium citrate | 20 |
| Boric acid | 10 |

The pH of the bath was adjusted to a value of 9.5 by the appropriate addition of potassium hydroxide or citric acid.

A brass panel was electroplated using the foregoing bath in the manner described in Example 1 to obtain a bright, white, ductile and extremely hard deposit, which on analysis was found to be the alloy 92.6% Au, 5.0% Pd and 2.4% Cu.

EXAMPLE 11

White Gold Alloy

An electroplating bath, which contained no conducting salt or buffering agent, was made up by dissolving in demineralised water the following constituents. With the exception of the surface active agent the concentrations of the said constituents are expressed in grams/-liter:

| | |
|---|---|
| Ammonium gold sulphite | 10 (as gold) |
| Palladium diammine dinitrite | 1.5 (as palladium) |
| Copper sulphate | 0.1 (as copper) |
| Ammonium sulphite | 50 (as sulphite ion) |

The pH of the bath was adjusted to a value of 7–7.5 by the appropriate addition of ammonium hydroxide or citric acid.

A brass panel was electroplated using the foregoing bath in the manner described in Example 1 to obtain a bright, white ductile and extremely hard deposit consisting of the alloy 90% Au, 7% Pd and 3% Cu.

EXAMPLE 12

White Gold Alloy

An electroplating bath was prepared by dissolving in demineralised water the following constituents. With the exception of the surface active agent the concentrations of the said constituents are expressed in grams/-liter:

| | |
|---|---|
| Potassium gold sulphite | 10 (as gold) |
| Potassium palladium sulphite | 1.5 (as palladium) |
| Copper sulphate | 0.2 (as copper) |
| Potassium sulphite | 40 (as sulphite ion) |
| Potassium citrate | 20 |
| Boric acid | 10 |

The pH of the bath was adjusted to a value of 9.5 by the appropriate addition of potassium hydroxide or citric acid.

A brass panel was electroplated using the foregoing bath in the manner described in Example 1 to obtain a bright, white, ductile and extremely hard deposit, which on analysis was found to be the alloy 93% Au, 5% Pd and 2% Cu.

What is claimed is:

1. An aqueous, alkaline cyanide-free electroplating bath for depositing a white gold alloy onto a substrate which comprises:
   (1) an alkali metal gold sulphite or ammonium gold sulphite;
   (2) a water soluble copper alloying salt or copper alloying complex;
   (3) a water soluble palladium alloying salt selected from the group consisting of alkali metal palladium sulphite, ammonium palladium sulphite or palladium citrate; and (4) an alkali metal sulphite or ammonium sulphite.

2. The bath of claim 1 wherein the alkali metal gold sulphite is selected from among sodium gold sulphite and potassium gold sulphite.

3. The bath of claim 1 wherein the water soluble copper alloying salt is selected from among copper sulphate, copper tartrate or copper citrate.

4. The bath of claim 1 inclusive of a buffering agent of a conducting salt selected from among an alkali metal, alkaline earth metal or an ammonium phosphate, borate, sulphate, carbonate, acetate, citrate, gluconate, tartrate or boric acid.

5. A method for plating a white gold alloy onto a substrate which comprises immersing said substrate in an aqueous, alkaline cyanide-free electroplating bath consisting essentially of: (1) an alkali metal gold sulphite or ammonium gold sulphite; (2) a water soluble copper alloying salt or copper alloying complex; (3) a water soluble palladium alloying salt selected from the group consisting of alkali metal palladium sulphite, ammonium palladium sulphite or palladium citrate; and (4) an alkali metal sulphite or ammonium sulphite; while maintaining the said bath at a pH of from about 7–12 and passing an electric current through said bath so as to deposit a gold coating onto said substrate.

6. The method of claim 5 wherein the pH of said bath is maintained within a range of from about 7–10.5.

7. The method of claim 5 wherein the said plating bath includes a buffering agent or conducting salt selected from among an alkali metal, alkaline earth or an ammonium phosphate, borate, sulphate, carbonate, acetate, citrate, gluconate, tartrate or boric acid.

8. The method of claim 5, wherein the gold, palladium and copper comprising the white gold alloy are present in amounts of from about 85–95% gold, 3–10% palladium and 2–5% copper by weight.

9. The method of claim 8 wherein the said gold, palladium and copper are present in the amount of 89–93% gold, 5–8% palladium and 2–3% copper by weight.

10. An aqueous, alkaline cyanide-free electroplating bath for depositing a pink gold alloy onto a substrate which comprises:

(1) an alkali metal gold sulphite or ammonium gold sulphite;

(2) a water soluble copper alloying salt or copper alloying complex;

(3) a water soluble palladium alloying salt selected from the group consisting of an alkali metal palladium sulphite, ammonium palladium sulphite or palladium citrate;

(4) an alkali metal sulphite or ammonium sulphite; and (5) a water soluble brightening agent in the form of a salt, complex or chelate comprised of arsenic, antimony or thallium, and a surface active agent.

11. The bath of claim 10 wherein the alkali metal gold sulphite is selected from among sodium gold sulphite or potassium gold sulphite.

12. The bath of claim 10 wherein the water soluble copper alloying salt is selected from among copper sulphate, copper tartrate or copper citrate.

13. The bath of claim 10 inclusive of a buffering agent or conducting salt selected from among an alkali metal, alkaline earth metal or an ammonium phosphate, borate, sulphate, carbonate, acetate, citrate, gluconate, tartrate or boric acid.

14. The bath of claim 10 wherein the said brightening agent is arsenic trioxide.

15. The bath of claim 10 wherein the said surface active agent is selected from among an alkyl phosphate ester or an alcohol alkoxylate.

16. A method for plating a pink gold alloy onto a substrate which comprises immersing said substrate in an aqueous, alkaline cyanide-free electroplating bath consisting essentially of: (1) an alkali metal gold sulphite or ammonium gold sulphite; (2) a water soluble copper alloying salt or copper alloying complex; (3) a water soluble palladium alloying salt selected from the group consisting of an alkali metal palladium sulphite, ammonium palladium sulphite or palladium citrate; (4) an alkali metal sulphite or ammonium sulphite; and (5) a water soluble brightening agent in the form of a salt, complex or chelate comprised of arsenic, antimony or thallium, and a surface active agent; while maintaining the said bath at a pH of from about 7–12 and passing an electric current through said bath so as to deposit a gold coating onto said substrate.

17. The method of claim 16 wherein the pH of said bath is maintained within a range of from about 7–11.5.

18. The method of claim 16 wherein the said plating bath includes a buffering agent or conducting salt selected from among an alkali metal, an alkaline earth metal or an ammonium phosphate, borate, sulphate, carbonate, acetate, citrate, gluconate, tartrate or boric acid.

19. The method of claim 18 wherein the buffering agent is tripotassium citrate.

20. The method of claim 16 wherein the water soluble brightening agent is arsenic trioxide.

21. The method of claim 16 wherein the surface active agent is an anionic alkyl phosphate ester.

22. The method of claim 16 wherein the gold, copper and palladium comprising the pink gold alloy are present in amounts of from about 86–94% gold, 2–8% copper and 2–6% palladium by weight.

23. The method of claim 22 wherein the said gold, copper and palladium are present in the amount of 88–90% gold, 7–8% copper and 3–4% palladium by weight.

24. An aqueous, alkaline cyanide-free electroplating bath for depositing a white gold alloy onto a substrate comprising potassium gold sulphite, potassium palladium sulphite, copper citrate, potassium sulphite, ammonium citrate and boric acid, said bath having a pH of about 9.5.

25. An aqueous, alkaline cyanide-free electroplating bath for depositing a pink gold alloy onto a substrate comprising potassium gold sulphite, copper sulphate, palladium citrate, potassium sulphite, tripotassium citrate, arsenic trioxide and an alkyl phosphate ester surfactant, said bath having a pH of about 9.5.

* * * * *